US005323628A

United States Patent [19]

Mori et al.

[11] Patent Number: 5,323,628

[45] Date of Patent: Jun. 28, 1994

[54] DOOR INTERLOCK ARRANGEMENT FOR WASHING MACHINES

[75] Inventors: Maurizio Mori; Roberto Bottosset, both of Pordenone, Italy

[73] Assignee: Zanussi Elettrodomestici S.P.A., Italy

[21] Appl. No.: 114,649

[22] Filed: Aug. 31, 1993

[30] Foreign Application Priority Data

Sep. 17, 1992 [IT] Italy ..... PN92A000065

[51] Int. Cl.[5] ..... D06F 33/02

[52] U.S. Cl. ..... 68/12.26; 68/23 R; 292/DIG. 69

[58] Field of Search ..... 68/12.01, 12.26, 23; 134/58 DL, 57 DL; 292/DIG. 69

[56] References Cited

U.S. PATENT DOCUMENTS

| | | | |
|---|---|---|---|
| 3,272,935 | 9/1966 | Beller et al. | 68/12.26 |
| 3,638,457 | 2/1972 | Filipak | 68/12.26 |
| 3,735,610 | 5/1973 | Haller | 68/12.26 |
| 4,230,350 | 10/1980 | Gee et al. | 292/DIG. 69 |
| 4,623,179 | 11/1986 | Davis et al. | 292/DIG. 69 |
| 4,995,650 | 2/1991 | Scantz et al. | 292/DIG. 69 |
| 5,050,407 | 3/1991 | Wild | 68/12.26 |

OTHER PUBLICATIONS

European Patent Application 349,494 Jan. 1990.

*Primary Examiner*—Frankie L. Stinson

*Attorney, Agent, or Firm*—Pearne, Gordon, McCoy & Granger

[57] ABSTRACT

A clothes washing machine including a washing tub containing a drum and a door for closing the drum provided with a door interlock arrangement. The door interlock arrangement includes an electromagnet (1), a main sliding element (4), a door catch (5), a spring (6) forcing said main sliding element back to its resting position, an inclined plane (9) of the door catch, a switch (2) actuated by the main sliding element (4), a device (10) that is electrically energized during spin-extraction phases only, a peg (11) projecting from the device (10) when the latter is not energized, and a recess (12) for accommodating the projecting peg (11) in the main sliding element (4). The main sliding element (4) also includes a recess (8) for accommodating the door catch (5). A secondary sliding element (3) is provided so as to be able to slide transversely with respect to the main sliding element (4). A spring (7) acts upon the secondary sliding element (3), and an upper edge (13) of the main sliding element (4) is capable of cooperating by interference with a downward projection (14) of the secondary sliding element (3).

9 Claims, 2 Drawing Sheets

DOOR INTERLOCK ARRANGEMENT FOR WASHING MACHINES

BACKGROUND OF THE INVENTION

1. Field of the Invention

This invention relates to clothes washing machines in general, and front-loading clothes washing machines which are equipped with a particular, improved type of door interlock arrangement as a safety provision, in particular.

2. Description of the Related Art

Household-type clothes washing machines are known to be equipped with different types of variously featured door interlock arrangements. Such door interlock systems can be grouped into one of the following categories according to their operating principle:

1) Devices keeping the door locked throughout the washing process and allowing delayed (i.e. after 1 to 2 minutes) door release with respect to the actual moment at which the machine is de-energized upon completing its duty cycle.

This type of safety door interlock arrangement is effective in protecting the user against his/her being able to gain access to dangerous moving parts, i.e. parts rotating at dangerous speeds, such as during the spin-extraction phase of the process. It also prevents the user from unduly opening the loading door of the machine even in the remaining portions of the washing cycle in the case of a faulty condition arising in washing machines equipped with an electronically controlled driving motor.

However, this type of safety door interlock arrangement has two major drawbacks: the first one is related to the fact that it forces the user to wait a couple of minutes each time that he/she wants for any reason to open the loading door of the machine during the washing cycle, even during phases thereof that do not involve dangerous rotating speeds of the drum.

The second drawback is apparent when the main on-off switch of the washing machine is switched on and the loading door of that same machine is open. Under such conditions, the washing machine would readily start operating as soon as its door is closed, thereby activating the process phase that is set on the program selector switch and causing the loading door to be locked under the action of the door interlock device itself.

Such a door closure under the above-mentioned conditions may obviously occur in a fully unintentional way and, as a consequence, may give rise to accidents with serious damage not only to things, but also to children and animals that may have accidentally climbed into the drum of the washing machine when the loading door was open and the drum was standing still.

2) Devices keeping the door locked only when the drum rotates at dangerous speeds, i.e. during spin-extraction phases, with a provision allowing for delayed door release after de-energization of the machine.

Such safety door interlock arrangements are only effective in protecting the user against accidents caused by improper door openings during spin-extraction phases (since no dangerous rotating speed is involved in the other phases of the cycle) and have the advantage of allowing the loading door to be readily opened in all other phases of the washing process. However, they have a major drawback in that they still practically enable accidents of the type described as the second major drawback under 1) above to occur.

3) Devices keeping the door locked through the action of an electromagnet.

These door interlock devices enable the loading door of the washing machine to be opened during any phase of the washing process in which the drum is not rotating at any dangerous speed.

When on the contrary the drum is rotating at a dangerous speed, there are further devices provided inside the machine to prevent the door interlock arrangement from becoming de-energized due to normal handling by the user and, as a consequence, the loading door from being opened.

However, such a type of door interlock arrangement has a third major drawback in that, if the solenoid, or coil, of the interlock device happens to be de-energized due to any faulty condition or by accident, the washing machine remains electrically energized and, therefore, enabled to keep performing all phases provided for by the washing process being carried on (including those involving dangerous operating conditions), while the door can be opened at any moment.

SUMMARY OF THE INVENTION

It therefore would be desirable, and is an object of the present invention, to provide a clothes washing machine equipped with a door interlock device which is capable of acting so as to keep the door locked, under delayed release, only when phases involving dangerous rotation speeds of the drum are being carried out, while making it possible to readily open the door during the remaining phases of the washing process, thereby doing away with one of the aforecited drawbacks.

Such a door interlock arrangement should furthermore be arranged so as to be capable of making it impossible to close the door when the washing machine is already energized i.e. the power supply has been switched on in order to prevent it from being started unintentionally, thereby doing away with another afore-cited drawback.

It should also be provided with a switch means that is operatively linked with the core of the electromagnet, i.e. is dependent on the position thereof, so that, should the coil become de-energized following an interruption of its circuitry due to the occurrence of a failure or breakdown, the core will at the same time be able to cause the contacts of said switch means to separate, i.e. to break, when sliding back to the position it has when the electromagnet is in its de-energized state. Under such a circumstance, the switch means will in turn switch off the whole machine and in this way protect the user against dangerous conditions, thereby also eliminating the third afore-cited drawback.

Such a door interlock arrangement shall further be of simple and cost-effective construction, reliable operation, and shall make use of normally available manufacturing techniques.

These and further aims are reached in a clothes washing machine provided with a door interlock arrangement as substantially described below and in the appended claims. The devised solution according to the present invention essentially involves providing a door interlock arrangement with two sliding elements, of which the first sliding element co-operates with an appropriate recess to stop the movement of the door locking catch and the second sliding element blocks said door catch in the opposite direction with respect to said movement, wherein said first sliding element is being prevented from sliding by a peg as controlled by the electric circuit of the washing machine.

BRIEF DESCRIPTION OF THE DRAWINGS

In order to let it be more clearly understood, the invention will be further described by way of non-limiting example with reference to the accompanying drawings, in which.

Figure 1:
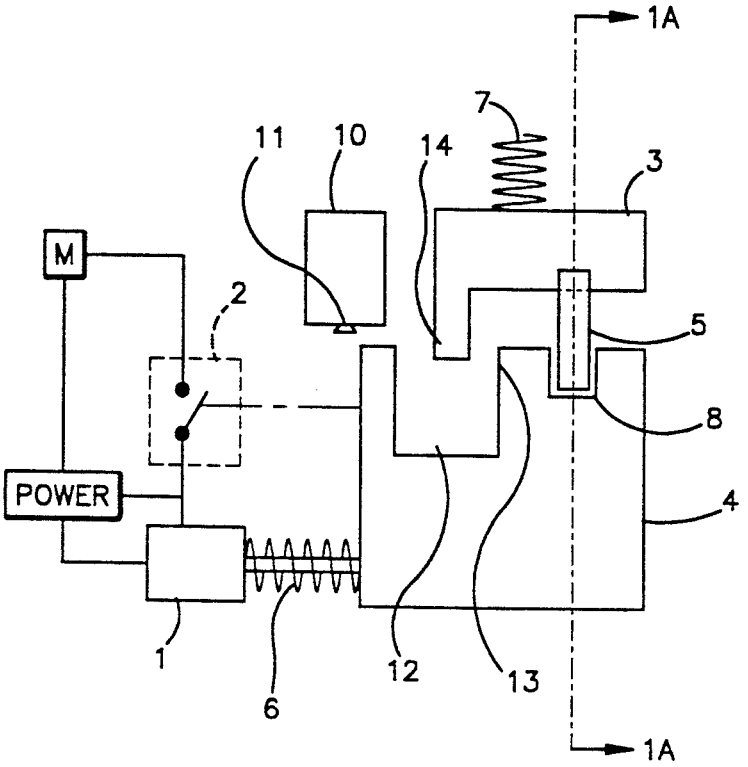
FIGS. 1 and 1A are schematic views of a door interlock arrangement according to the present invention, in the condition in which the washing machine is not energized and the loading door is open.
Figure 1A:
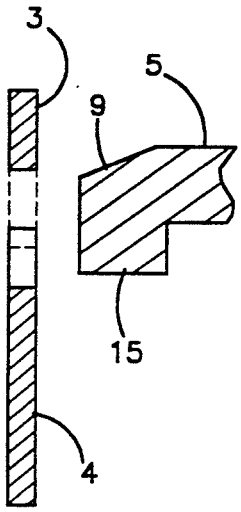

In each pair of the above mentioned Figures, the right-side portion thereof shows a cutaway view of the drawing on the left side (European projection).

DETAILED DESCRIPTION OF THE PREFERRED EMBODIMENTS

Referring now to the figures, the following parts of a door locking arrangement according to the present invention are shown. A washing machine having a wash tub and a rotating drum is provided with a loading door for closing the drum. A door interlock arrangement includes a main sliding element 4 which slides in a horizontal direction (with respect to the figures and not in an absolute sense, since the arrangement can be made according to different embodiment forms and be positioned in different Ways). An electromagnet 1 is provided to operate the main sliding element 4 so as to slide the sliding element to the left when the electromagnet is energized. The electromagnet 1 is connected to a power source for the washing machine so as to be energized when the washing machine is energized. A switch means 2 is connected in series with the power source and a drum driving motor. The switch 2 is activated by the main sliding element 4 so as to de-energize the motor when the sliding element is slid to the right.

A secondary sliding element 3 slides in a vertical direction with respect to the figures. A door catch 5 is mounted on the loading door and moves by sliding right to left with reference to the right side FIGS. 1A through 4A when the door is being closed. A spring 6 forces the main sliding element 4 back into its resting position when the machine is de-energized and the loading door is opened. The spring is normally relieved and is loaded by compression when the electromagnet 1 is energized. A second spring 7 forces the secondary element 3 into its resting position. The second spring 7 is normally relieved and is compression loaded to act against the structure of the door interlock device when an inclined plane 9 of the door catch 5 comes into contact with the secondary element 3 thereby lifting the secondary element and compressing said spring 7.

The main sliding element 4 is provided with a recess 8 through which the door catch enters into the sliding element 4.

A device 10 is provided with a peg 11 so that when the device is energized electrically during spin-extraction phases of a washing cycle, the device causes the peg 11 to jut out. The device 10 is adapted so that the peg recedes approximately one minute after the device 10 has been de-energized. The main sliding element 4 is provided with a recess 12 through which the peg 11 enters into the sliding element 4. The main sliding element 4 is provided with a left side upper edge 13, the secondary sliding element 3 is provided with a downward projection 14, and the door catch 5 is provided with a downward projection 15.

The operation of the described door interlock arrangement is as follows:

Resting State

Referring to FIG. 1, a washing machine equipped with a door lock according to the invention is in a de-energized state, and its loading door is open.

The electromagnet is in its resting state (not energized); the switch means 2 has open contacts, in series with the drum driving motor and power supply; the secondary sliding element 3 is in its lowered position; and the primary sliding element 4 is in such a position as to let the recess 8 enable the door catch 5 to slide into the recess.

Energization: The Loading Door is Closed While the Machine is De-energized

Figure 2:
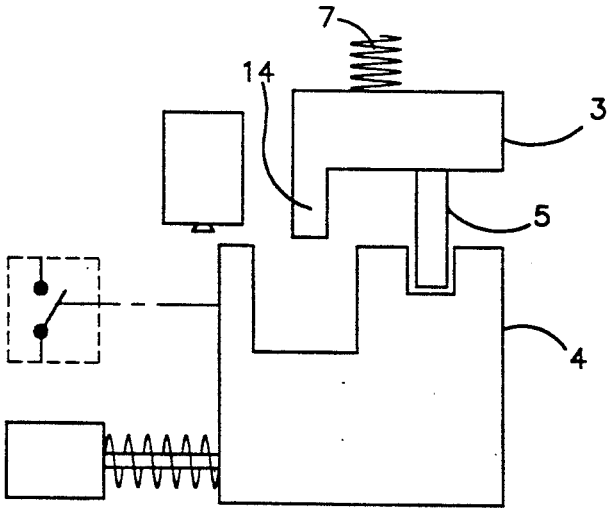
FIGS. 2 and 2A are schematic views showing the door interlock arrangement of FIGS. 1 and 1A in the condition in which the loading door is closed, while the machine is not yet energized.
Figure 2A:
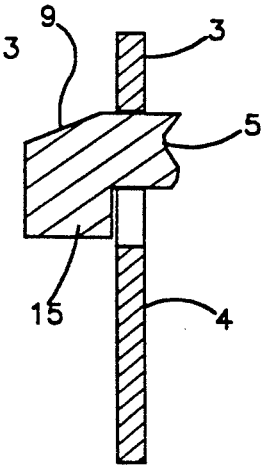
Figure 3:
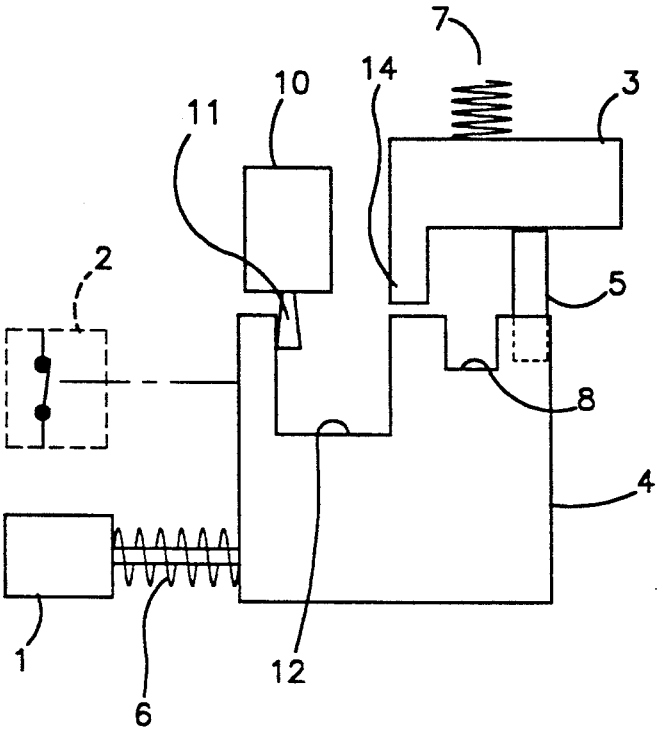
FIGS. 3 and 3A are schematic views showing the door interlock arrangement of FIGS. 1 and 1A in the condition in which the loading door is closed, while the washing machine is energized and a spin-extraction phase is occurring.
Figure 3A:
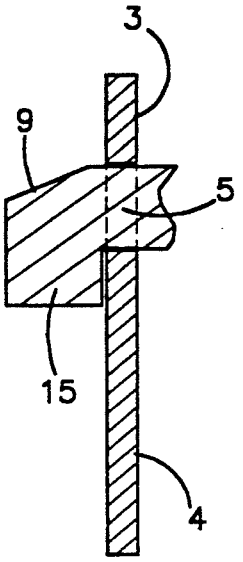

After loading the clothes into the drum, the loading door of the washing machine is closed and the door catch 5 slides into the recess 8 (by moving from right to left in FIG. 2A). When entering in such a way into said recess, the inclined plane 9 of the door catch 5 displaces the sliding element 3 upwardly so as to enable the sliding element 4 to move leftwardly as it is attracted by the electromagnet 1. The washing machine is switched on and the electromagnet i is energized automatically. As a consequence, the sliding element 4 is attracted to move leftwardly, thereby causing the contacts of the switch means 2 to close as shown in FIG. 3.

With the arrangement in this configuration, the door catch 5 can no longer be retracted, since its lower downward projection 15 is blocked from movement by the new position of the sliding element 4.

Normal Operation

During normal operation of the washing machine, the loading door thereof can only be opened readily if the washload-holding drum is not rotating at a high speed, i.e. the machine is not performing spin-extraction.

As a matter of fact, it is only during a spin-extraction phase that the device 10 is energized by an appropriate electrical circuit, thereby causing the peg 11 to jut out and engage an edge of the appropriately provided recess 12 of the sliding element 4 so as to prevent the latter from sliding back for a period of approximately minute, or another predetermined period of time, after the subsequent de-energization of the electromagnet 1. This is effective in preventing the loading door from being opened during said predetermined period of time starting from the moment at which the power supply is switched off and the washing machine is de-energized. The drum slows down progressively from a "dangerous" rotating speed (spin-extraction) to a full standstill state in said period of time. Such a safety provision, i.e. the delayed door lock release, is a standard requirement.

Once this safety period of time has elapsed, the peg 11 is retracted automatically, thereby enabling the sliding element 4 to move back rightwardly under the action of the spring 6. This causes the sliding member 4 to be displaced into such position as to move the recess 8 in correspondence of the door catch 5, thereby enabling said door catch 5 to be withdrawn and, as a consequence, the loading door to be opened.

Loading Door is Closed During Operation, i.e. When the Washing Machine is Already Energized or Operating In the state in which the washing machine is regularly energized while its loading door is open, the electromagnet 1 automatically attracts the sliding element 4 to move towards said electromagnet.

Figure 4:
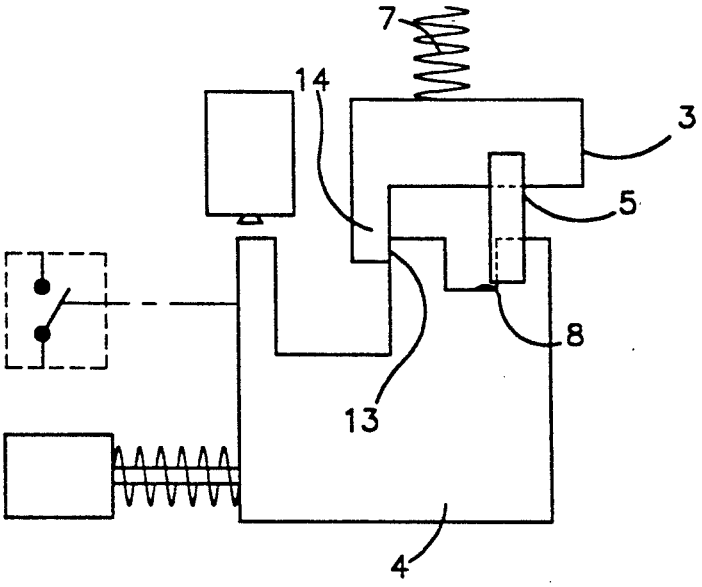
FIGS. 4 and 4A are schematic views showing the door interlock arrangement of FIGS. 1 and 1A in the condition in which the washing machine is energized and an attempt is being made to close the loading door.
Figure 4A:
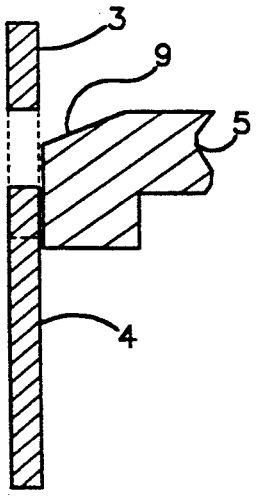

In moving leftwardly, said sliding element 4 is unable to reach its outer position to its left side, since it is stopped by engagement of its edge 13 with the downward projection 14 of the sliding element 3, which is still in its resting position, i.e. in its lowered condition (see FIG. 4).

When an attempt is made to close the loading door, the door catch 5 (which moves along a fixed path, as constrained by the trajectory defined by the closing door) will strike against the sliding element 4, since the recess 8 has been displaced to the left by the attracting action of the electromagnet 1, so that the door catch 5 cannot enter into the recess.

The loading door is in this way prevented from being closed through a simple action, thereby assuring at the same time compliance with a definite standard requirement.

It will of course be appreciated that each washing machine may be equipped with a door interlock arrangement that is embodied in any different form as considered to be appropriate without departing from the scope of the present invention.

In particular, the described sliding elements may consist of appropriate elements that are able to move according to various methods, and in various ways, by translation, rotation or a combination thereof.

Although the preferred embodiments of this invention have been shown and described, it should be understood that various modifications and rearrangements of the parts may be resorted to without departing from the scope of the invention as disclosed and claimed herein.

What is claimed is:

1. Washing machine comprising a wash tub containing a rotating drum; a door for closing said drum; and a door interlock arrangement, said door interlock arrangement comprising an electromagnet (1); a main sliding element (4) slidingly operated by the electromagnet; a catch (5) disposed on the door and interacting with the main sliding element so as to lock the door closed; a spring means (6) opposing operation of the main sliding element by the electromagnet so as to force said main sliding element back into a resting position; an inclined plane (9) of said door catch; a switch means (2) actuated by said sliding element (4); a device (10) that is electrically energized during spin-extraction phases only; a peg (11) that extends out of said device (10) when the latter is energized, and recedes into said device (11) when the latter is de-energized; and a recess (12) in the main sliding element for admitting said projecting peg (11) into said main sliding element (4), characterized in that said main sliding element (4) also comprises a recess (8) for receiving the door catch (5); a secondary sliding element (3) pushed by the incline (9) when the catch is inserted in the recess (8) is provided so as to be capable of sliding transversely with respect to said main sliding element (4); a spring means (7) opposing operation by the incline is provided to act upon said secondary sliding element (3); and an upper edge (13) of said main sliding element (4) is capable of interfering with a projection (14) of said secondary sliding element (3) to block movement thereof.

2. Washing machine according to claim 1, characterized in that said switch means (2) is connected in series with a power supply circuit of the machine and in parallel with said electromagnet (1), and the switch means is caused to close by a sliding motion of said main sliding element (4); said sliding motion of the sliding element occurs with energization of said electromagnet, said main sliding element being biased back into its resting position by the action of the spring means (6); said main sliding element (4) is released into sliding along its sliding path by a first position of the secondary sliding element (3), and is prevented from sliding along its sliding path by a second position of said secondary sliding element (3), wherein said first position of the secondary sliding element (3) is determined by the pushing action exerted by the incline plane (9) of the door catch (5) against said secondary sliding element when it is inserted in the door interlock arrangement, and wherein said second position of said secondary sliding element is determined by the biasing action exerted by the spring means (7) upon said secondary sliding element when the door catch is withdrawn from the door interlock arrangement.

3. Washing machine according to claim 2, characterized in that the door catch (5) is provided with a projection (15) capable of being introduced into said recess (8) of said main sliding element (4) when said sliding element is not attracted by the electromagnet (1), and capable of interfering with said main sliding element when the latter is caused to slide under the action of the electromagnet (1), so that when the loading door is open said projection prevents it from being closed and, when the loading door is closed, prevents it from being opened.

4. Washing machine according to claim 3, characterized in that when the main sliding element is caused to be displaced by the attracting action of the electromagnet (1), the peg (11) projecting out of the device (10) prevents the main sliding element (4) from sliding back under the biasing action of the spring means (6) after the electromagnet (1) is de-energized and, therefore, no longer attracting.

5. Washing machine according to claim 4, characterized in that the electromagnet (1) is energized by the power supply to the machine being switched on, as well as by a program control device of the machine.

6. Washing machine according to claim 5, characterized in that said device (10) is only energized during certain process phases, as controlled by a program control device, and causes said peg (11) to retract only after a pre-determined period of time has elapsed since its de-energization.

7. Washing machine according to claim 6, characterized in that said sliding elements are cursor means moving by translation.

8. Washing machine according to claim 4, characterized in that said device (10) is only energized during certain process phases, as controlled by a program control device, and causes said peg (11) to retract only after a pre-determined period of time has elapsed since its de-energization.

9. Washing machine according to claim 8, characterized in that said sliding elements are cursor means moving by translation.

* * * * *